US005165505A

United States Patent [19]

Hayashi et al.

[11] Patent Number: 5,165,505

[45] Date of Patent: Nov. 24, 1992

[54] ELEVATOR LANDING DOOR APPARATUS

[75] Inventors: Yoshikatsu Hayashi; Masami Yoshikawa; Makoto Tomidokoro; Yoshinari Kuzuya, all of Aichi, Japan

[73] Assignee: Mitsubishi Denki Kabushiki Kaisha, Japan

[21] Appl. No.: 767,631

[22] Filed: Sep. 30, 1991

[30] Foreign Application Priority Data

Oct. 1, 1990 [JP] Japan ..... 2-263516

[51] Int. Cl.[5] ..... B66B 13/22

[52] U.S. Cl. ..... 187/62; 187/1 R; 49/7; 49/475

[58] Field of Search ..... 187/62, 1 R; 411/171; 49/7, 8, 475, 493

[56] References Cited

U.S. PATENT DOCUMENTS 1,508,515 9/1924 Gervais ..... 49/7
1,551,687 9/1925 Prelle ..... 49/7
4,282,687 8/1981 Teleskivi .
4,735,293 4/1988 Everhart et al. ..... 187/1 R X

FOREIGN PATENT DOCUMENTS 3502032 8/1985 Fed. Rep. of Germany .
2610311 2/1987 France .
55-31185 7/1980 Japan .
55-31188 7/1980 Japan .
56-37984 4/1981 Japan .
59-29025 8/1984 Japan .
61-75189 4/1986 Japan .
63-148685 9/1988 Japan .

*Primary Examiner*—Robert P. Olszewski
*Assistant Examiner*—Dean A. Reichard
*Attorney, Agent, or Firm*—Leydig, Voit & Mayer

[57] ABSTRACT

The elevator landing door apparatus is provided with a door for opening and closing the doorway at an elevator landing zone, a rail for guiding the rollers of a hanger plate installed in an upright position in the upper part of the door just defined, and a sill for guiding a door shoe set in the lower part of the door laid out in the lower part of the doorway defined above. The elevator landing door apparatus is characterized in that a plate is set up in an upright position on the upper frame of three-side frames in the doorway defined above and a closure plate is set up in the upper part of the door defined above and forms an overlapping construction together with the plate when the door is shut. This closure plate is fitted out with an expansive material which expands by the effect of heat and thereby the clearance between the plate and the closure plate.

3 Claims, 7 Drawing Sheets

ELEVATOR LANDING DOOR APPARATUS

BACKGROUND OF THE INVENTION

The present invention relates to an elevator landing door apparatus, and, more particularly, it relates to improvements on the construction of a fire-resistant door for an elevator landing zone.

FIG. 11 and FIG. 12 illustrate a conventional elevator landing door apparatus disclosed in such references as the official gazette on utility model laid open, No. 148685-1988 (Showa 63). In these drawings, the reference number (1) denotes a doorway for the elevator landing, and this doorway (1) is provided with three-side frames (2). A sill (4) is laid down on the landing zone floor (3) in the above-mentioned doorway (1). The three-side frames (2) mentioned above are comprised of a pair of mutually opposing vertical frames (2*a*) and an upper frame (2*b*) suspended horizontally between the upper parts of this pair of vertical frames (2*a*). Also, a groove (4*a*) is made in a concave formation in the longitudinal direction on the upper surface of the sill (4) as illustrated in FIG. 12. The reference number (5) indicates a plural number of doors for opening and closing the doorway (1), and this door (5) is provided with a surface plate (6) which has a section approximately in a groove shape and forms a decorated surface, as shown in FIG. 12, vertical reinforcing members (7) having a section approximately in the shape of a hat and welded vertically onto the side of this surface plate (6), namely, the side opposite to the decorated surface, and a back plate (9) covering the opening in the back surface of the surface plate (6) at the side of the elevator shaft (8) and set with a screw in the vertical reinforcing material (7), and a clearance (C) (refer to FIG. 12) is formed between the three-side frames (2) and the sill (4). The reference number (10) indicates a hanger plate which is installed in an upright position in the upper part of the doors (5). On the elevated section of this hanger plate (10), a plural number of rollers (11) are mounted each with pivot in a such a manner as to permit their rotation, as shown in FIG. 11. The reference number (12) indicates a rail which is mounted horizontally on the wall at the side of the elevator shaft (8) and is thus positioned above the upper frame (2*b*), and this rail (12) is so arranged that it engages and guides the above-mentioned rollers (11). Then, the reference number (13) indicates a plural number of door shoes fitted out to the lower part of the door (5), and these door shoes (13) are inserted with free play into the above-mentioned groove (4*a*) in such a manner as to permit their free sliding motion therein and to be guided accordingly.

Therefore, the doors (5) will move smoothly to open and to close the doorway (1), being guided by the rail (12) and the groove (4*a*), on the basis of their engagement with the doors (now illustrated) for the elevator cab.

In this regard, conventional art literature of this kind includes the official gazette on utility model laid open, No. 31188-1980 (Showa 55) and No. 29025-1984 (Showa 59), official gazette on patent laid open, No. 37984-1981 (Showa 56) and No. 75189-1986 (Showa 61), and U.S. Pat. No. 4,282,687 in addition to the official gazette cited above.

The conventional elevator landing door apparatus is constructed as described above, and the apparatus certainly has a clearance (C) between the doors (5), the three-side frames (2), and the sill (4), so that the opening and closing of the doors (5) can be thereby made smooth. Therefore, when a fire breaks out in a building, smoke and flames will flow from the elevator landing zone into the elevator shaft (8), which produces a chimney effect, via the clearance (C), with the result that damages are inflicted On other floors. With a view to overcoming this problem, it has hitherto been in practice to provide an elevator landing zone with fire-preventing and smoke-preventing apparatuses comprised of such items as fire-preventing and disaster-preventing shutters. Yet, the use of such facilities for the conventional apparatus inevitably involves problems such as increased costs, restrictions related to the installation of such fire-preventing and smoke-preventing apparatuses, inefficient use of the landing zone space, and deteriorations of attractive appearance.

SUMMARY OF THE INVENTION

The present invention has been made in view of the problems described above and has as its object to provide an elevator landing door apparatus which is capable of achieving improvements on fire-preventing functions, the omission of the fire-preventing and smoke-preventing apparatuses installed separately up to the present time, and simplification of their constructions.

In order to accomplish the above-mentioned object of the present invention, the elevator landing door apparatus according to a first aspect of the present invention is provided with a door for opening and closing the doorway at an elevator landing zone, a rail for guiding the rollers of a hanger plate installed in an upright position in the upper part of the door just defined, and a sill for guiding a door shoe set in the lower part of the door laid out in the lower part of the doorway defined above, wherein the elevator landing door apparatus is characterized in that a plate is set up in an upright position on the upper frame of three-side frames in the doorway defined above and a closure plate is set up in the upper part of the door defined above and forms a halving joint construction together with the plate when the door is shut. This closure plate is fitted out with an expansive material which expands by the effect of heat and thereby closes the clearance between the plate and the closure plate.

Further, the elevator landing door apparatus according to the present invention is provided with a door for opening and closing the doorway at an elevator landing zone, a rail for guiding the rollers of a hanger plate installed in an upright position in the upper part of the door defined above, and a sill for guiding a door shoe set in the lower part of the door laid out in the lower part of the doorway defined above, wherein the elevator landing door apparatus is characterized in that the door defined above is comprised of a main unit with vertical reinforcing members built therein for supporting the weight of the door. A heat insulating panel is also installed rigidly on the surface of this main unit of the door facing the elevator landing zone side and having heat insulating material filled up in the inside area thereof. The heat insulating material, which expands by the effect of heat and thereby prevents the influx of a heat flow from the above-mentioned door stopper into the elevator shaft, being held between the above-mentioned main unit of the door and the heat insulating panel defined above.

The elevator landing door apparatus according to the present invention, moreover, is provided with a door for opening and closing the doorway at an elevator landing zone, a rail for guiding the rollers of a hanger plate installed in an upright position in the upper part of the door just defined, and a sill for guiding a door shoe set in the lower part of the door laid out in the lower part of the doorway defined above, wherein the elevator landing door apparatus is characterized in that the door defined above is comprised of a main unit having vertical reinforcing members built therein for supporting the weight of the door. A heat insulating panel is installed rigidly on the surface of this main unit of the door facing the elevator landing zone side and having heat insulating material filled up in the inside area thereof. A lower part mounting plate is suspended between the lower part reinforcing member in the lower part of the above-mentioned main unit of the door and the lower part of the heat insulating panel defined above. This lower part mounting plate is fitted with expansive material which expands by the effect of heat and thereby closes the clearance between the heat insulating panel and the sill.

Furthermore, in order to accomplish the object of the present invention, the elevator landing door apparatus according to a second aspect of the present invention is characterized by being provided with a door, which opens and closes the doorway at an elevator landing zone fitted out with three-side frames, and a sill, which guides a door shoe set in the lower part of the door laid out in the lower part of the doorway defined above, wherein the elevator landing door apparatus is characterized by being further provided with sealing plates which are set in the upper part, side parts, and lower part of the door defined above and move and form closures in the clearances between the door and the three-side frames and the sill, and provided further with stoppers which will fuse at or above a prescribed temperature, thereby moving the sealing plates which have been forming closures in the clearances.

According to the first aspect of the present invention, a plate is set up in an upright position on the upper frame of the three-side frames in the doorway and closure plate which forms an overlapping construction with the plate at the time of a closure of the above-mentioned door is installed on the upper part of the door defined above, with expansive material which will expand by the effect of heat and thereby form a closure in the clearance between the plate and the upper part halving joint plate being installed on the upper part in the inside area of this closure plate, so that the elevator landing door apparatus is capable of preventing smoke and flames from flowing into the inside area of the elevator shaft from the elevator landing zone via the clearance between the upper frame and the door.

Moreover, the door at the elevator landing zone is comprised of a main unit having vertical reinforcing members supporting the weight of the door and a heat insulating panel installed rigidly on the surface of the main unit of the door on the side of the elevator landing zone and having heat insulating material set inside it, with expansive material which expands by the effect of heat held between a door stopper for the above-mentioned main unit of the door and the insulating panel defined above. The elevator landing door apparatus is capable of preventing smoke and flames from flowing into the inside area of the elevator shaft from the elevator landing zone by way of the clearance in the door stopper of the door.

Furthermore, the door at the elevator landing zone is constructed with a main unit having built-in reinforcing members supporting the weight of the door and with a heat insulating panel installed rigidly on the surface of this main unit of the door on the side of the elevator landing zone. Heat insulating material is fitted therein, with a lower part mounting plate being suspended between the lower part reinforcing members set in the lower part of the above-mentioned main unit of the door and the heat insulating panel defined above and also with expansive material which expands by the effect of heat and forms a closure in the clearance between the heat insulating panel and the sill being fitted out on this lower part mounting plate, so that the elevator landing door apparatus is capable of preventing smoke and flames from flowing into the inside area of the elevator shaft from the elevator landing zone via the clearance between the door and the sill.

Also, according to the second aspect of the present invention, the elevator landing door apparatus is provided with sealing plates which are installed in the upper part, side parts, and lower part of the door and will respectively move in the clearances between the door and the three-side frames, and the sill, forming closures therein, and provided further with stoppers which fuse at or above a predetermined temperature and thereby move the sealing plates which have been forming the closures in the clearances, so that the elevator landing door apparatus is capable of preventing smoke and flames from flowing into the inside area of the elevator shaft via the clearance between the door and the three-side frames or the sill.

DETAILED DESCRIPTION OF THE PREFERRED EMBODIMENTS

Figure 1:
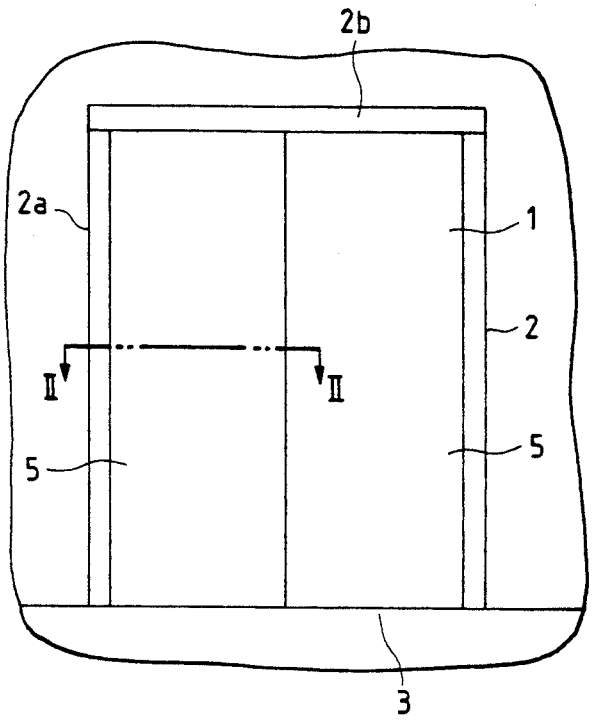
FIG. 1 presents a front view illustrating an elevator landing door apparatus according to the first aspect of the present invention as viewed from the elevator landing zone.

In the subsequent part, the elevator landing door apparatus according to the first aspect of the present invention will be described in detail on the basis of the examples of preferred embodiments thereof illustrated in FIG. 1 through FIG. 5. In these drawings, the reference number (5) indicates a door for opening and closing the doorway (1), and, as shown in FIG. 2, this door (5) is constructed in a thick structure comprised of multiple layers formed of a main unit (14) of the door and a heat insulating panel (16) having an approximately groove-shaped section and installed rigidly on the surface of this main unit of the door on the side of the elevator landing zone with a plural number of mounting metal fittings (15), and thus the door is capable of attaining a quite considerable heat insulating effect.

Figure 2:
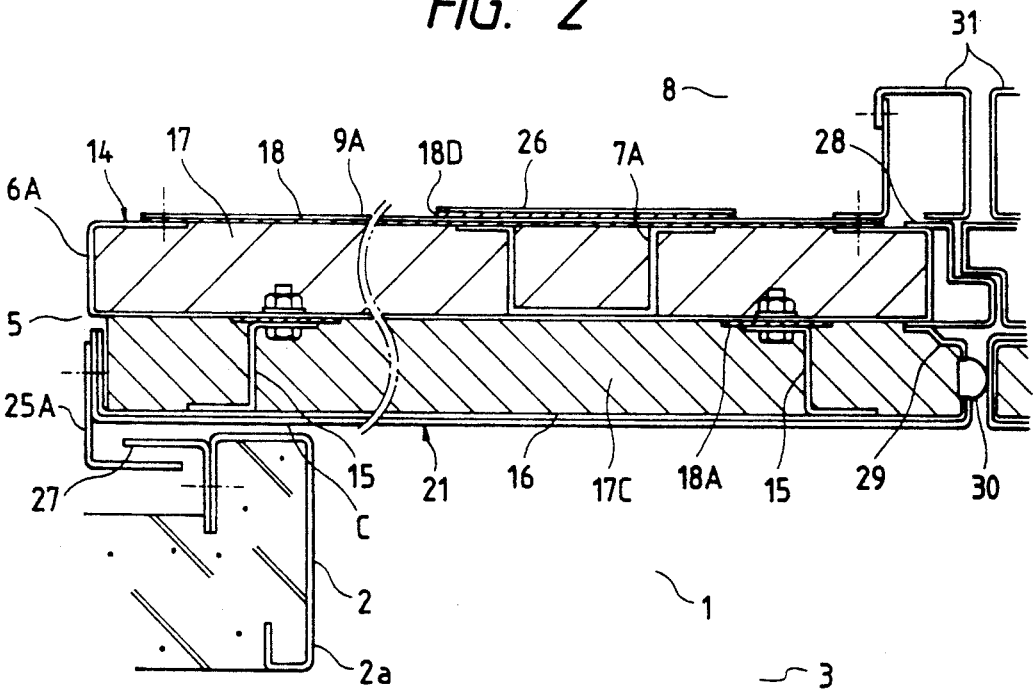
FIG. 2 presents a sectional view of the elevator landing door apparatus as viewed in its section at the line from II to II indicated in FIG. 1.
Figure 4:
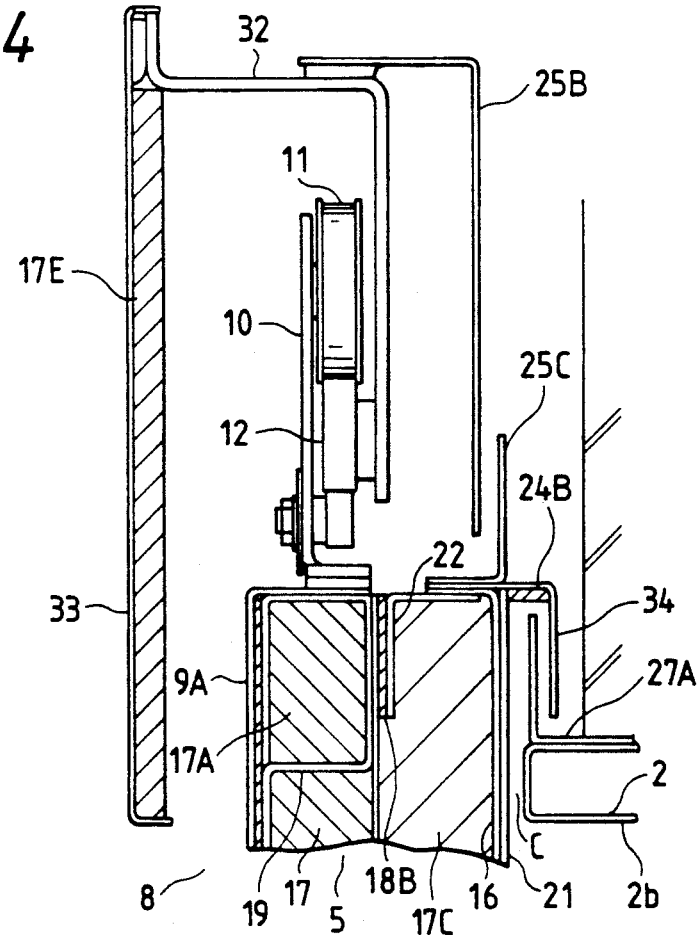
FIG. 4 presents a vertical sectional view illustrating the upper parts of the door and the landing door apparatus.
Figure 5:
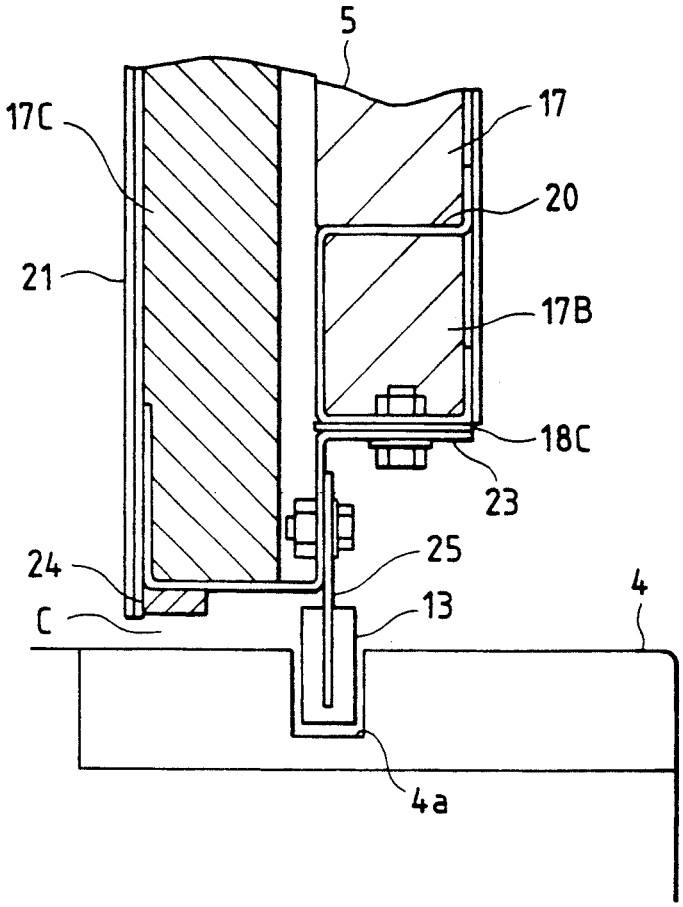
FIG. 5 presents a vertical sectional view illustrating the lower part of the door.

The above-mentioned main unit (14) of the door is provided, as shown in FIG. 2, with a surface plate (6A) in an approximately groove-shaped section, a vertical reinforcing material (7A) formed in an approximately hat-shaped section and welded in an upright position almost in the center of the inside area of this face plate (6A) and having strength necessary for supporting the self-weight of the door (5) and also for enabling the door (5) to perform its smooth opening and closing operations, and a back plate (9A) installed in such a manner as to cover the opening in the back surface of the surface plate (6A), namely on its surface at the side of the elevator shaft (8), and heat insulating material (17) which places restraint on the conduction of heat to the back surface of the door (5) is inserted in the inside area of the main unit of the door. A heat insulating sheet (18), which reduces the amount of heat conducted between metals, is placed in its interposition between the surface plate (6A) mentioned above and the vertical reinforcing material (7A) and the back plate (9A). Also, the upper part of the back plate (9A) is formed in an inverted L-shape by its horizontal bending as illustrated in FIG. 4, so that the strength of the upper part of the door (5) is thereby increased. Further, the back plate (9A) and the surface plate (6A) are connected through an oblong hole, so that it is made possible to prevent a deformation like that of bimetal which is caused by temperature differences among various component parts at the time of a fire. Moreover, an upper part reinforcing member (19) is fixed in the upper part of the main unit (14) of the door as shown in FIG. 4, and this upper part reinforcing member (19), being thus positioned above the doorway (1), is so constructed as to place restraint on the rise of temperature in the upper area of the door (5) and also to support the weight of the door (5). In this regard, heat insulating material (17A), which restrains thermal conduction in the upper area of the door (5), is inserted in the upper part reinforcing member (19). Additionally, a lower part reinforcing member (20) is provided in the lower part of the main unit (14) of the door as shown in FIG. 5, and heat insulating material (17B) is inserted in the inside area of this lower part reinforcing member (20).

The mounting metal fittings (15) are formed in a section in an approximately Z-letter shape as shown in FIG. 2 in an effort to reduce their area of metal contact, and one end part is mounted with a screw applied with a tightening tool on the surface of the surface plate (6A) while the other end part is fixed on the inside surface of a heat insulating panel (16). The route for the conduction of heat from the heat insulating panel (16) to the main unit (14) of the door is thus extended to form a construction which places restraint on a rise of temperature on the surface of the elevator shaft (8). Also, a heat insulating sheet (18A), which cuts off the heat otherwise conducted from the mounting metal fittings (15) to the surface plate (6A) is arranged between one end part of the mounting metal fittings (15) and the surface plate (6A).

The heat insulating panel (16) is finished with a decorated plate (21), which has excellent decorative features and is formed in an approximately groove-shaped section, covering the front surface of the above-mentioned panel on the side of the elevator landing zone, as shown in FIG. 2, and heat insulating material (17C) is inserted between the surface plate (6A) and the decorated plate (21). The decorated plate mentioned above and the heat insulating panel (16) are connected through an oblong hole and thereby form a construction capable of preventing a deformation like that of bimetal caused by differences in temperature among various component parts at the time of a fire. Moreover, the heat insulating material (17C) mentioned above is composed of expensive materials superior in heat resistance to the heat insulating material (17) mentioned above and is accordingly made to achieve a heat insulating effect more effectively in the heat insulating panel (16), which is exposed to a high temperature at the time of a fire. Moreover, this heat insulating material (17C) is formed into cotton-like heat insulating material scarcely liable to the growth of a gap in the parts of the material positioned on both sides while the material positioned in the central part thereof is formed into a board-shaped heat insulating material convenient for the assembly work, the respective parts of the material being inserted to form the arrangement mentioned above. Moreover, the heat insulating panel (16) is formed in such a manner that both sides thereof form a gap for restraining a rise in the temperature on the surface of the elevator shaft (8). Then, upper part mounting metal fittings (22) in the shape of an inverted L, which are positioned above the doorway (1), are fixed rigidly in the upper part of the heat insulating panel (16), as shown in FIG. 4. These upper part mounting metal fittings (22) are fixed rigidly in the upper part of the surface plate (6A) by way of the heat insulating sheet (18B). Moreover, the lower part of the heat insulating panel (16) is positioned below the lower part of the main unit (14) of the door as shown in FIG. 5, and a lower part mounting plate (23) is suspended between the lower part of the heat insulating panel (16) and the lower part reinforcing material (20). A heat insulating sheet (18C) is arranged between the lower part mounting plate (23) and the lower part reinforcing member (20). As shown in FIG. 5, the lower part mounting plate (23) is provided with expansive material (24) which, being set on the bottom part positioned above the lower end of its decorated plate (21), expands by the effect of heat at the time of a fire and thereby closes up the clearance (C) between the sill (4) and the clearance (C). A heat rectifying plate (25) is mounted with a screw on the jogged part on its upright area, and a door shoe (13), which is to be inserted in a freely movable state into a groove (4*a*), is installed on the lower part of this heat rectifying plate (25). Therefore, the door shoe (13) will be position in the proximity of the center of gravity for the door (5). Moreover, the heat rectifying plate (25) mentioned above and the groove (4*a*) are constructed so that the plate fits between the walls of the groove (4*a*).

The reference number (26) indicates a high temperature zone cover mounted on the back plate (9A). As shown in FIG. 2, a heat insulating sheet (18D), which is positioned to face the vertical reinforcing member (7A) and cuts off the heat conducted via the vertical reinforcing member (7A) with high thermal conductivity, is placed in interposition between this high temperature zone cover (26) and the back plate (9A). This example of a preferred embodiment, moreover, shows a construction in which the heat insulating sheet (18D) is arranged in a position where it faces the vertical reinforcing member (7A), but the part which is to face the heat insulating sheet (18D) will not be limited to this vertical reinforcing member (7A) so long as such a part is one having high thermal conductivity.

The reference number (25A) indicates a heat insulating plate which has a section in an approximately L-shape and is mounted on one side of the decorated plate (21) on the shutter box side, and the reference number (27) indicates a plate having a section in an approximately L-shape and mounted on a vertical frame (2*a*) of the three-side frames (2), and this plate (27) and the heat insulating plate (25A) together form an overlapping structure at the time of a closure of the door (5), so that it prevents smoke accompanied with heat from flowing into the elevator shaft (8) through the clearance (C) of the door (5).

Figure 3:
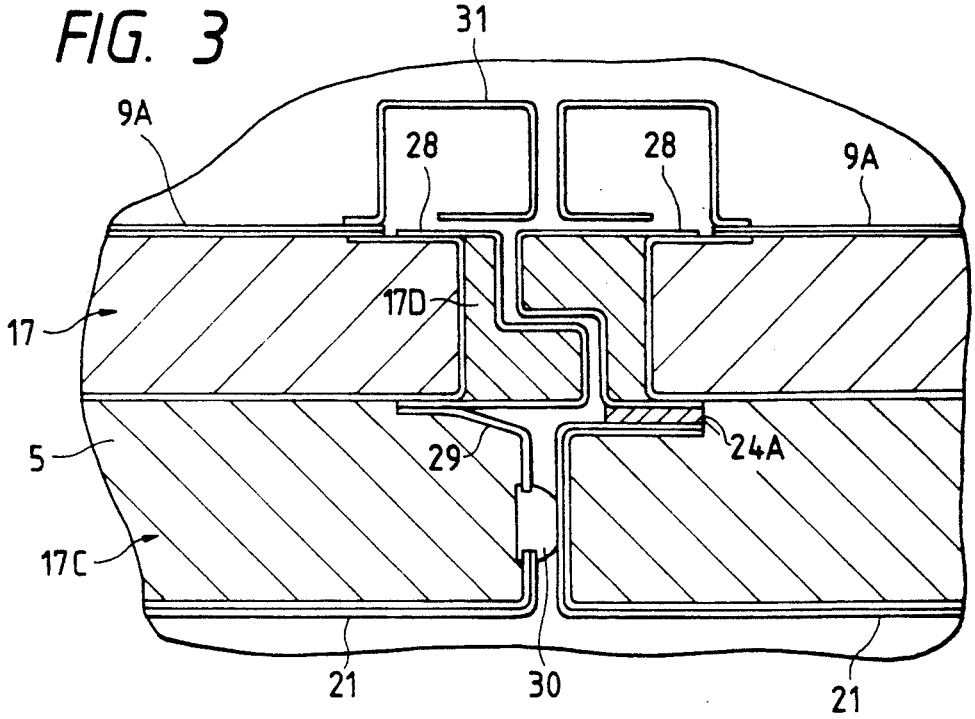
FIG. 3 presents a horizontal sectional view illustrating the structure of a section of the door stoppers at the time of a closure of the door.

The reference number (28) indicates a door stopping plate mounted on each of the door stopper parts facing each other in close proximity in the main units (14) of the door (14) and (14), and this door stopping plate (28) is provided with heat insulating material (17D) inserted in the inside area thereof and producing a heat insulating effect, as shown in FIG. 2 and FIG. 3, and these door stopping plates (28) approach ,each other to be positioned side by side in proximity, with a clearance left between them when the door (5) is closed, and these door stopping plates (28) are constructed to place restraint on the amount of smoke accompanied with heat which will flow into the elevator shaft (8) from the door stoppers. Additionally, the door stopping plates (28) are arranged, by virtue of its construction, in such a manner that the stroke of the left door (5) and that of the right door (5) are made equal with their face measure center being set to deviate from the center of the actual doorway (1). The reference number (29) indicates is a metal clamper mounted on the surface on the elevator landing zone side of the door stopping plate (28) which is positioned on the left side in the illustration given in FIG. 3. A door stopping rubber (30), which has an approximately semicircular section and set along the overall length in the longitudinal direction of the door (5), is held between this metal clamper (29) and the decorated plate (21), these forming a construction in which this door stopping rubber (30) is brought into its direct contact with the decorated plate (21) on the right side in the illustration given in FIG. 3 when the door (5) is closed. The reference number (24A) indicates expansive material interposed between the door stopping plate (28) and the decorated plate (21), and this expansive material (24A) will expand with heat at the time of a fire and closes the clearance between the decorated plate (21) on the right side of the illustration given in FIG. 3 and the door stopping plate (28) on the left side of the same illustration, thereby preventing smoke accompanied with heat from flowing into the elevator shaft (8) through the clearance mentioned above.

The reference number (31) indicates a blind plate mounted on the back plate (9A), and this blind plate (31) is formed with a section in an approximately square pipe shape and positioned on the side of the door stopping plate (28) facing the elevator shaft (8), as illustrated in FIG. 3, and is so constructed that it guides air, which will achieve a cooling effect, in the vertical direction.

The reference number (10) indicates a hanger plate mounted in an upright position on the upper part of the back plate (9A), which forms a part of the main unit (14) of the door, and this hanger plate (10) has rollers (11) capable of performing rotating motion and forming a construction in which they are engaged and guided by a rail (12) which suspends the door in the vicinity of its center of gravity. The reference number (32) indicates a hanger case which has this rail (12) and the landing door apparatus and so forth built in it, and this hanger case (32) has holes made in the upper part on the side of the elevator shaft (8) for discharging a heat flow which has flown into the inside area of the hanger case, and heat insulting material (17E) is fitted out on the inner surface of a hanger case cover (33) as illustrated in FIG. 4. Also, a heat rectifying plate (25B) in an inverted L-shape is installed on the upper part of the hanger case (32) on the side of the wall of the elevator shaft (8). Holes for discharging a heat flow which has flown into the inside area of the hanger case (32) are made through the upper part of this heat rectifying plate (25B). The reference number (34) indicates an upper halving joint plate in an inverted L-shape, which is mounted on the upper part of the heat insulating panel (16) and positioned above the upper frame (2*b*) of the three-side frames (2), and this upper part halving joint plate (34) is made in a width size larger than that of the door (5). The reference number (27A) indicates a plate formed in an L-shape and installed in an upright position on the upper frame (2*b*), and this plate (27A) and the closure (34) form an overlapping structure when the door (5) is closed, as shown in FIG. 4, so that the halving joint. Accordingly, the overlapping structure thus formed prevents smoke accompanied with heat from flowing into the elevator shaft (8) through the clearance (C) between the upper frame (2*b*) and the door (5). Then, expansive material (24B) is fitted out on the upper part of the inside area of the closure plate (34) mentioned above, so that the expansive material (24B) expands with the heat generated at the time of a fire, thereby forming a closure in the clearance between the upper part halving joint plate (34) and the plate (27A). Moreover, a heat rectifying plate (25) in an L-shape is mounted in an upright position on the upper part of closure plate (34), and this heat rectifying plate (25C) and the heat rectifying plate (25B) together form an overlapping structure, with each other at the time of a closure of the door (5), as shown in FIG. 4, so that the structure thus formed inhibits smoke accompanied with heat from flowing into the inside area of the hanger case (32).

With the configuration described above, the plate (27A) and the closure plate (34) form an overlapping structure at the time of a closure of the door (5), as shown in FIG. 4, and it is therefore possible for the elevator landing door apparatus to place considerable restraint on the amount of smoke and flames flowing from the elevator landing zone into the elevator shaft (8) by way of the clearance (C) between the upper frame (2*b*) and the door (5) and spreading there at the time of a fire. Furthermore, as the expansive material (24B) fitted out on the closure plate (34), which is exposed to a high temperature at the time of a fire, will expand at the time of a fire, thereby closing up the clearance between the plate (27A) and the upper part halving joint plate (34), making it possible for the apparatus to work promptly and unfailingly to prevent smoke and flames from flowing and spreading into the inside area of the elevator shaft (8) through the clearance (C) between the upper frame (2*b*) and the door (5) via the clearance between the plate (27A) and closure plate (34).

Then, as the expansive material (24A) is interposed between the decorated plate (21) and the door stopping plate (28) as shown in FIG. 3 and expands at the time of a fire, closing the clearance between the door stoppers for the right and left doors (5) and (5), the apparatus is thereby capable of certainly preventing smoke and flames from flowing and spreading into the inside area of the elevator shaft (8) from the elevator landing zone via the clearance between the door stoppers for the door (5), thereby placing considerable restraint on the rise of temperature on the surface of the elevator shaft (8).

Moreover, as the expansive material (24) is fitted out on the bottom area of the lower part mounting plate (23), which is positioned above the lower end of the decorated plate (21) liable to be exposed to a high temperature at the time of a fire, this expansive material (24) expanding with the heat generated at the time of a fire and thereby forming a closure in the clearance (C) between the sill (4) and the lower part of the door (5), it is thereby made possible for the apparatus to work promptly and unfailingly to prevent smoke and flames from flowing and spreading from the elevator landing zone into the inside area of the elevator shaft (8) through the clearance (C) in between the sill (4) and the lower part of the door (5).

Moreover, as the expansive material (24A) is interposed between the decorated plate (21) and the door stopping plate (28) as shown in FIG. 3 and expands with the heat at the time of a fire, thereby closing the clearance between the door stoppers for the doors (5) and (5), it is possible for the apparatus to work unfailingly to prevent smoke and flames from flowing and spreading into the inside area of the elevator shaft (8) through the clearance between the door stoppers for the door (5), thereby placing considerable restraint on the rise of temperature on the surface of the elevator shaft (8).

Furthermore, as the expansive material (24) is placed on the bottom area of the lower part mounting plate (23) positioned above the lower end of the decorated plate (21), which will be exposed to a high temperature at the time of a fire, this expansive material (24) expanding with the heat at the time of a fire and forming a closure in the clearance (C) between the sill (4) and the lower part of the door (5), it is thereby made possible for the apparatus to work promptly and unfailingly to prevent smoke and flames from flowing and spreading from the elevator landing zone into the inside area of the elevator shaft (8) through the clearance (C) between the sill (4) and the lower part of the door (5).

In this regard, the heat rectifying plate (25A) shown in the example of preferred embodiment cited above is one simply mounted on the decorated plate (21), but the same action and effect can be achieved as in the example of preferred embodiment cited above also by providing the inner surface of the heat rectifying plate (25A) with expansive material which will expand with the heat generated at the time of a fire, thereby closing the clearance between the heat rectifying plate (25A) and the plate (27).

Figure 6:
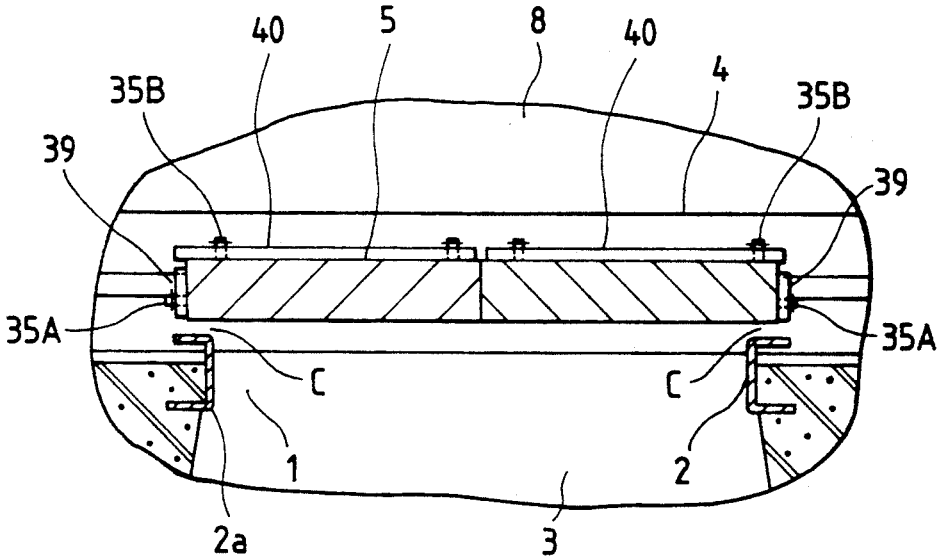
FIG. 6 presents horizontal sectional view illustrating the doorway part of an elevator landing door apparatus according to the second aspect of the present invention.
Figure 7:
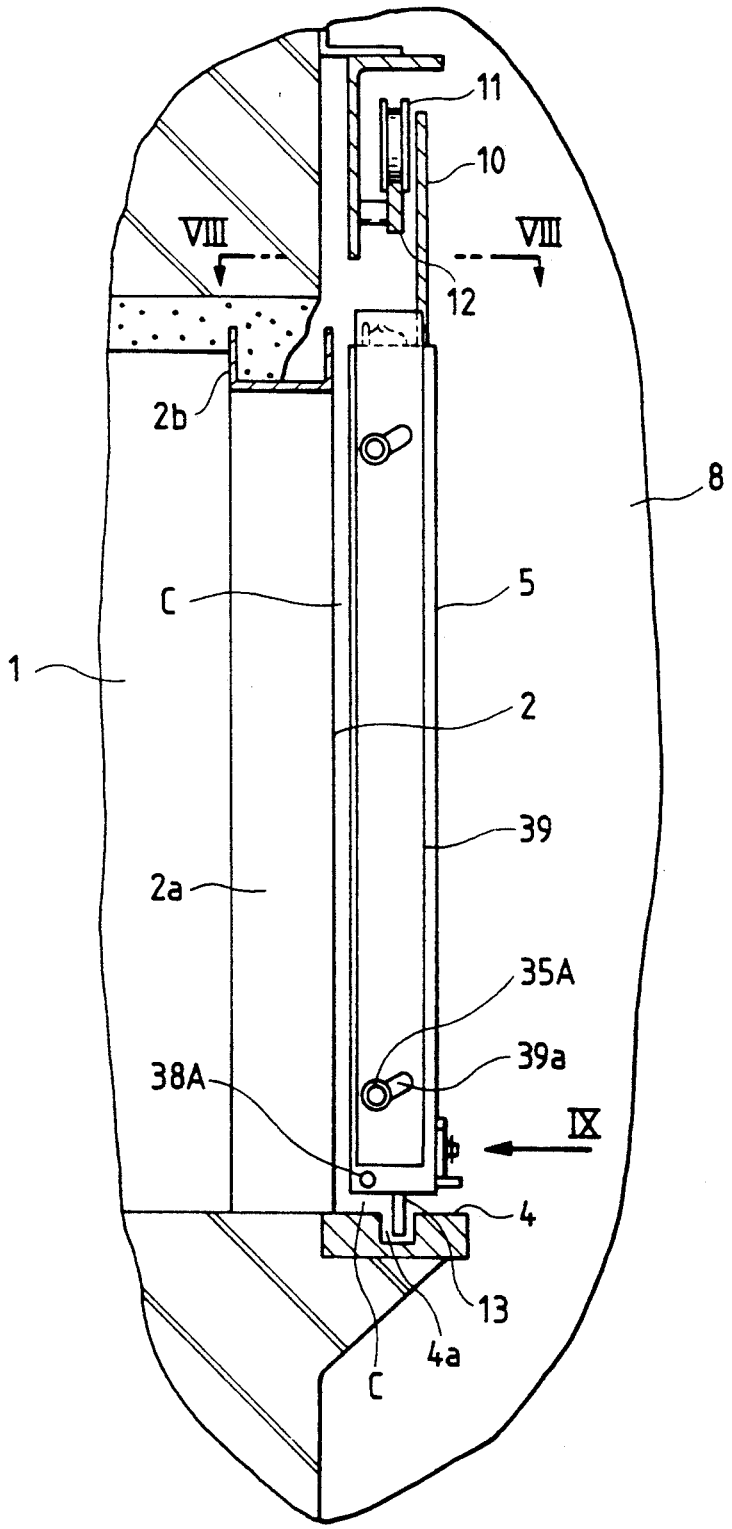
FIG. 7 presents a vertical sectional view illustrating the doorway part of the elevator landing door apparatus according to the second aspect of the present invention.
Figure 8:
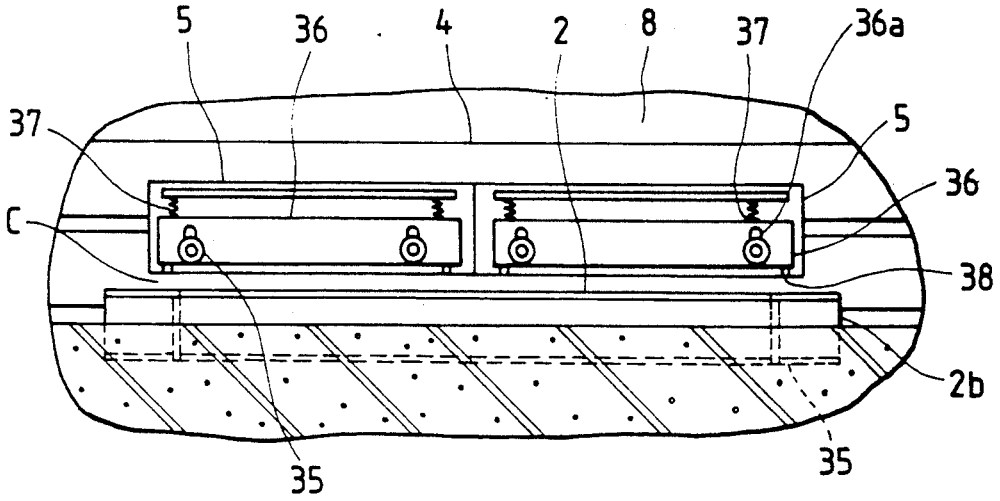
FIG. 8 presents a sectional view illustrating the elevator landing door apparatus in its section at the line from VIII to VIII indicated in FIG. 7.

Next, the second aspect of the present invention will be described in detail with reference to an example of preferred embodiment illustrated in FIG. 6 through FIG. 10. In these drawings, the reference number (5) indicates a door for closing the doorway (1), and a plural number of shafts (35) are set up in an upright position on both ends at the upper part of this door (5), as shown in FIG. 8 and FIG. 10. The reference number (36) indicates an upper part sealing plate, which is arranged in the upper part of the door (5) and freely movable in the horizontal direction, and oblong holes (36*a*) penetrating in a freely movable state through the plural number of shafts (35) are made respectively in both ends of this upper part sealing plate (36) in a plate shape, as shown in FIG. 8. Further, a plural number of coiled springs (37), which move the upper part sealing plate (36) at the time of a fire, thereby closing up the clearance (C) between the upper frame (2*b*) and the upper part of the door (5), are suspended between the upper part sealing plate (36) and the .hanger plate (10). The reference number (38) indicates a plural number of stoppers set in an upright position on both ends in the upper part of the door (5), and these stoppers (38), which are made of material that will fuse with the heat to which they are exposed at the time of a fire, are engaged with the upper part sealing plate (36), as shown in FIG. 8, thereby inhibiting the movement of the upper part sealing plate (36), but will be fused, as shown in FIG. 10, at the time of a fire, thereby permitting the upper part sealing plate (36) to move along with the return of the coiled springs (37) compressed until such a time.

The reference number (35A) indicates a plural number of shafts installed horizontally on the side part of the door (5), and the reference number (39) indicates freely movable side part sealing plates, which are set in an overlapping relationship with the side parts of the door (5). In these side part sealing plates (39) a plate-shape, oblong holes (39*a*), which respectively penetrate in a freely movable state through the plural number of shafts (35A), are made respectively at an inclination in the upward-downward direction as shown in FIG. 6, FIG. 7, and FIG. 10, to form a construction by which the sealing plates (39) will move at the time of a fire to close the clearance (C) between the vertical frame (2*a*) and the door (5). The reference number (38A) indicates a single stopper installed horizontally at the lower end of the side part of the door (5), and this stopper (38A), which is made of material that will fuse with the heat at the time of a fire, in the same way as the stoppers (38) are made, supports the lower part of the side part sealing plate (39) in the ordinary time, as illustrated in FIG. 7, thereby inhibiting the plate (39) from its movement, but fuses at the time of a fire, as shown in FIG. 10, thereby restricting the side part sealing plate (39) from moving away by the effect of its self-weight.

Figure 9:
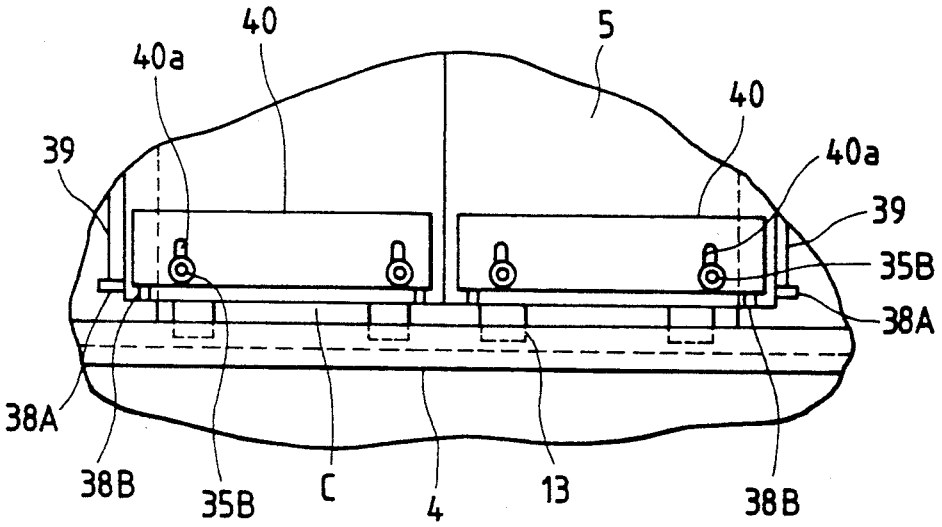
FIG. 9 presents a view illustrating the parts indicated with the arrow mark IX in FIG. 7.
Figure 10:
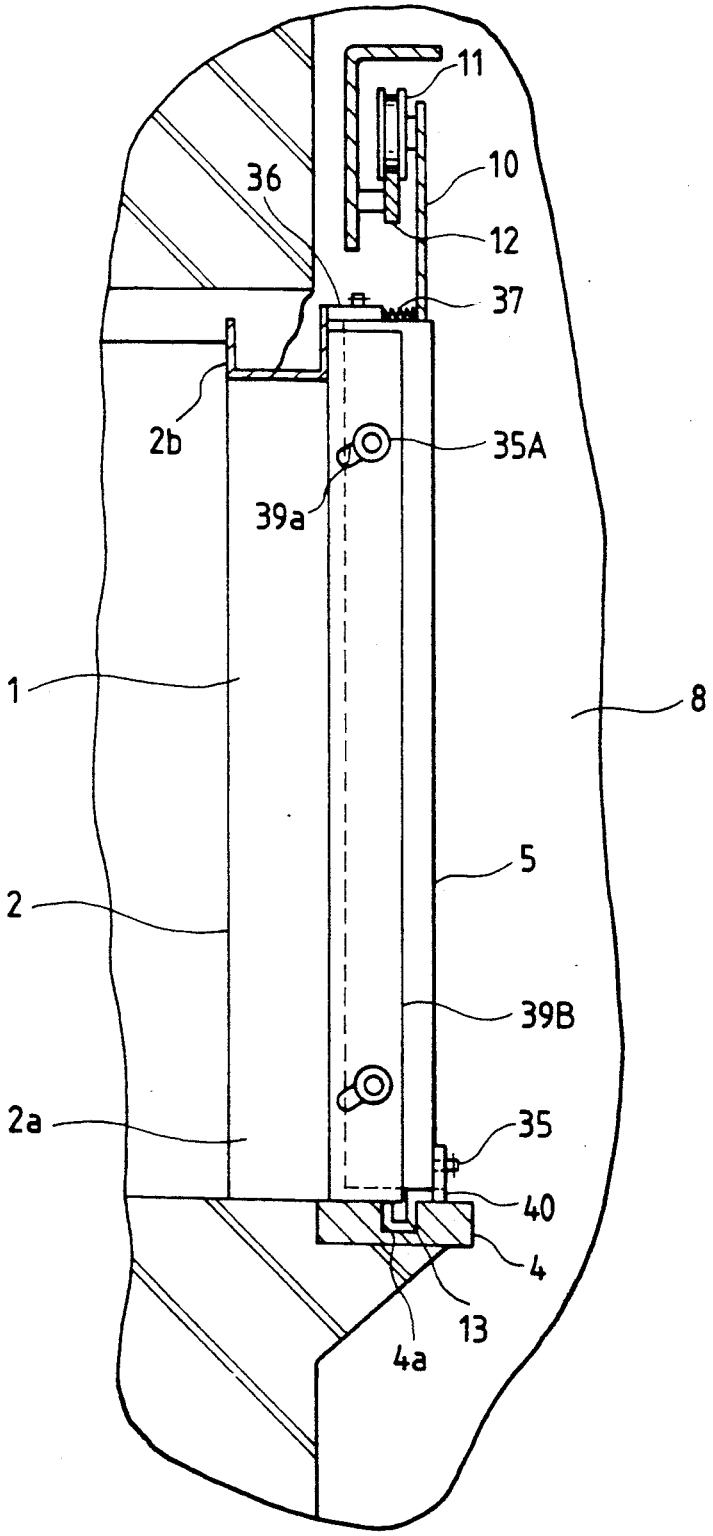
FIG. 10 presents a view illustrating the elevator landing door apparatus according to the second aspect of the present invention in its state at the time of the outbreak of a fire in correspondence to FIG. 7.
Figure 11:
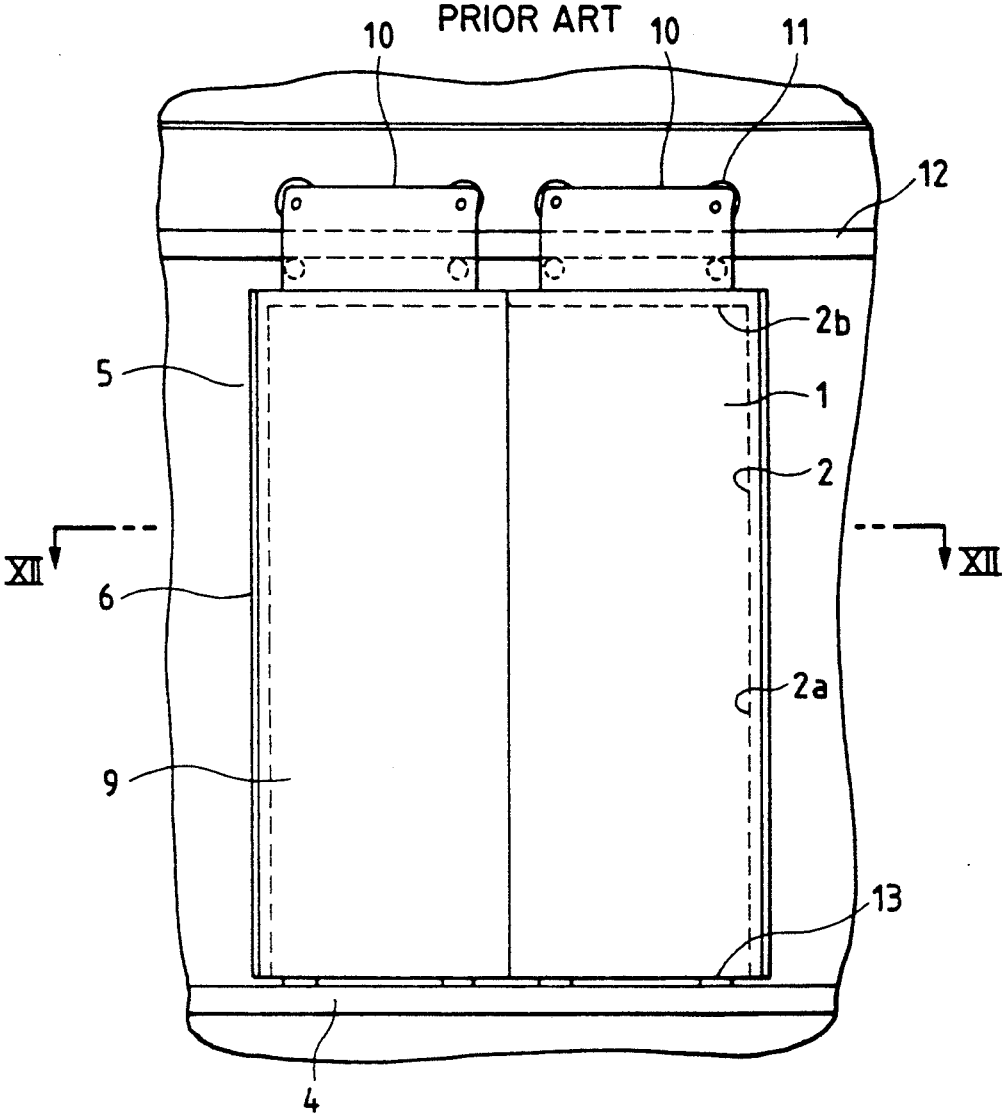
FIG. 11 PRIOR ART
FIG. 11 presents a rear view illustrating a conventional elevator landing door apparatus.
Figure 12:
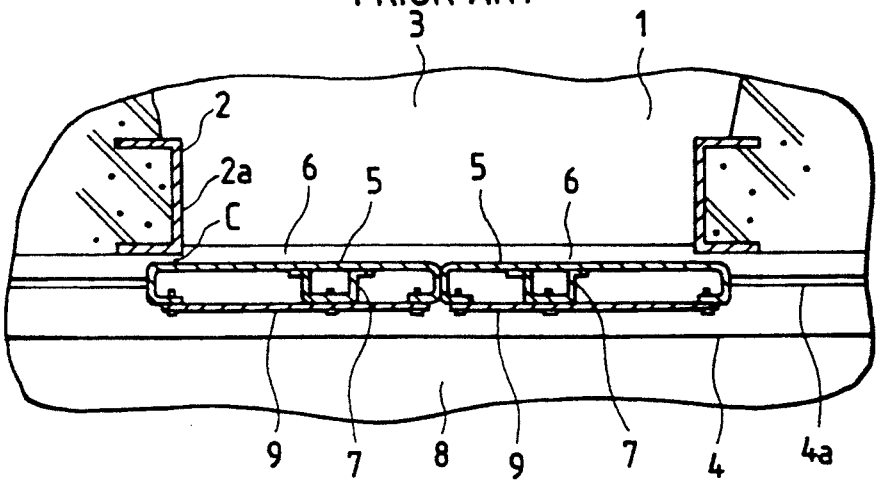
FIG. 12 PRIOR ART
FIG. 12 presents a sectional view illustrating the apparatus shown in FIG. 11 in its section at the line from XII to XII.

The reference number (35B) indicates a plural number of shafts set up horizontally on both ends of the lower part on the back surface of the door (5), and the reference number (40) indicates a lower part sealing plate, which is freely movable in the vertical direction and placed in overlapping relationship with the lower part of the back surface of the door (5), and, in this lower part sealing plate (40), oblong holes (40*a*) through which a plural number of shafts (35B) penetrate in a freely movable state are respectively made in the upward-downward direction, as shown in FIG. 7, FIG. 9, and FIG. 10. The shafts (35B) will move at the time of a fire, thereby forming a closure in the clearance (C) between the sill (4) and the lower part of the door (5). Then, the reference number (38B) indicates a plural number of stoppers installed horizontally at both ends of the lower part on the back surface of the door (5), and these stoppers (38B) are made of material which will fuse with the heat received at the time of a fire, in the same way as the stoppers (38) and (38A) are made, and support the lower part of the lower part sealing plate (40) in the ordinary time, as shown in FIG. 7, thereby inhibiting the plate from moving away, but will fuse, as shown in FIG. 10, at the time of a fire, thereby permitting the lower part sealing plate (40) to move by falling down by its self-weight.

Therefore, the stoppers (38) will fuse with heat and break when a fire breaks out in a building, and the coiled springs (37), which have been compressed until such a time, will be restored to their noncompressed state and will allow the upper part sealing plate (36) to move horizontally in the direction of the upper frame (2*b*), and the upper part sealing plate (36) moves horizontally in the direction of the upper frame (2*b*), being guided by the shaft (35), closing up the clearance (C) between the upper frame (2*b*) and the upper part of the door (5) and thereby unfailingly preventing the influx of smoke and flames into the elevator shaft (8) through the clearance (C) mentioned above.

Moreover, when a fire has broken out, the stoppers (38A), as well as the stoppers (38), will be fused by heat and disappear, so that the side part sealing plate (39) will move by the effect of its own weight in the direction of the vertical frame (2*a*), being guided by the shaft (35A), thereby closing up the clearance (C) between the vertical frame (2*a*) and the side part of the door (5), and unfailingly preventing smoke and flames from flowing into the elevator shaft (8) through the clearance (C) mentioned above.

Then, when a fire has broken out, the stoppers (38B) will be fused with heat and disappear, together with the stoppers (38) and the stoppers (38A), and the lower part sealing plate (40) will fall down and move by the effect of its self-weight, being guided by the shaft (35B), closing up the clearance (C) between the sill (4) and the lower part of the door (5) and unfailingly preventing the influx of smoke and flames into the elevator shaft (8) through the clearance (C) mentioned above.

As described above, the second aspect of the present invention offers an elevator landing door apparatus in which an upper part sealing plate (36), a side part sealing plate (39), and a lower part sealing plate (40) are respectively installed on the door in order to close up the clearance (C) between the door (5) and the three-side frames (2) and the sill (4) by the effect of the break of the stoppers (38), (38A), and (38B), and it is therefore possible for the apparatus to operate satisfactorily without any fire- preventing and smoke-preventing apparatuses, which would otherwise be required separately. In addition, the apparatus warrants the expectation of its capability of performing a sufficiently effective fire-preventing function with its extremely simple construction.

As described in the foregoing part, the first aspect of the present invention offers an elevator landing door apparatus in which the plate and the upper part closure plate form an overlapping structure at the time of a closure of the door, and which is therefore capable of placing considerable restraint on the amount of the smoke and flames flowing and spreading from the elevator landing zone into the elevator shaft through the clearance between the upper frame and the door in the event of an outbreak of a fire. Moreover, the expansive material installed on the closure plate, which will be exposed to a high temperature at the time of a fire, will expand with the heat generated at the time of a fire and will close up the clearance between the plate and the closure plate, and the apparatus is therefore capable of working promptly and unfailingly to prevent smoke and flames from flowing and spreading into the inside area of the elevator shaft through the clearance between the upper frame and the door by way of the clearance between the plate and the closure plate.

Then, as the expansive material set in interposition between a decorated plate and a door stopping plate will expand with the heat at the time of a fire, thereby forming a closure in the clearance between the door stoppers for the right and left doors, it is possible for the apparatus to place considerable restraint on the rise of temperature on the surface in the elevator shaft by unfailingly preventing smoke and flames from flowing and spreading from the elevator landing zone into the inside area of the elevator shaft via the clearance between the door stoppers for the door.

Moreover, expansive material is fixed on the bottom area of the lower part mounting plate positioned above the lower end of the decorated plate, which will be exposed to a high temperature in the event of the outbreak of a fire, and this expansive material will expand with the heat which it receives at the time of a fire, thereby forming a closure in the clearance between the sill and the lower part of the door. The apparatus is therefore capable of promptly and unfailingly preventing smoke and flames from flowing and spreading from the elevator landing zone into the elevator shaft through the clearance between the sill and the lower part of the door.

Furthermore, the second aspect of the present invention offers an elevator landing door apparatus in which the door is provided with an upper sealing plate, side part sealing plates, and a lower part sealing plate respectively arranged in such a way as to close up the clearances between the door and the three-side frames and the sill by the effect of the break of the stoppers, so that the apparatus can operate well without any fire-preventing or smoke-preventing apparatus, which has hitherto been installed separately. In addition, the apparatus can be expected to perform a satisfactory fire-preventing function even though it is extremely simple in construction.

What is claimed is:

1. An elevator landing door apparatus comprising:

a door for opening and closing the doorway at an elevator landing zone;

a rail for guiding the rollers of a hanger plate installed in an upright position in the upper part of said door;

a sill for guiding a door shoe set in the lower part of the door laid out in the lower part of said doorway;

a plate set up in an upright position on an upper frame of three-side frames in said doorway;

a closure plate set up in the upper part of said door for forming an overlapping construction together with said plate when the door is shut; and a member made of an expansive material and mounted on the closure plate, said member expanding by the effect of heat, thereby shutting up the clearance between the plate and the closure plate.

2. An elevator landing door apparatus comprising:

a door for opening and closing the doorway at an elevator landing zone, including a main unit having a door stopper and retaining therein vertical reinforcing members for supporting the weight of the door, and a heat insulating panel installed rigidly on the surface of this main unit of the door facing the elevator landing zone side and filled up with heat insulating material in the inside area thereof;

a rail for guiding the rollers of a hanger plate installed in an upright position in the upper part of said door;

a sill for guiding a door shoe set in the lower part of the door laid out in the lower part of said doorway; and a member made of an expansive material and held between the main unit and the heat insulating panel, the member expanding by the effect of heat, thereby obstructing the influx of a heat flow from the door stopper into the inside region of the elevator shaft.

3. An elevator landing door apparatus comprising:

a door for opening and closing the doorway at an elevator landing zone, including a main unit retaining therein vertical reinforcing members for supporting the weight of the door and a heat insulating panel installed rigidly on the surface of the main unit of the door facing the elevator landing zone side and filled up with heat insulating material in the inside area thereof;

a rail for guiding the rollers of a hanger plate installed in an upright position in the upper part of the door defined above;

a sill for guiding a door shoe set in the lower part of the door laid out in the lower part of said doorway;

a lower part mounting plate suspended between a lower part reinforcing member in the lower part of the main unit of the door and the heat insulating panel; and a member made of an expansive material and mounted on the lower part mounting plate, the member expanding by the effect of the heat, thereby closing up the clearance between the heat insulating panel and the sill.

* * * * *

UNITED STATES PATENT AND TRADEMARK OFFICE

CERTIFICATE OF CORRECTION

PATENT NO. : 5,165,505

DATED : November 24, 1992

INVENTOR(S) : Hayashi et al.

It is certified that error appears in the above-identified patent and that said Letters Patent is hereby corrected as shown below:

Claim 3, col. 14, line 21, delete "the" (second occurrence).

Signed and Sealed this

Thirtieth Day of November, 1993

Bruce Lehman

*Attest:*

BRUCE LEHMAN

*Attesting Officer*

*Commissioner of Patents and Trademarks*